US009777235B2

(12) United States Patent
Snaith et al.

(10) Patent No.: US 9,777,235 B2
(45) Date of Patent: Oct. 3, 2017

(54) FUEL OIL COMPOSITIONS AND PROCESSES

(71) Applicant: Allard Services Limited, Douglas (IM)

(72) Inventors: Paul Snaith, Kent (GB); John Francis Unsworth, Wrexham (GB)

(73) Assignee: Allard Services Limited, Douglas (IM)

( * ) Notice: Subject to any disclaimer, the term of this patent is extended or adjusted under 35 U.S.C. 154(b) by 0 days.

(21) Appl. No.: 15/284,995

(22) Filed: Oct. 4, 2016

(65) Prior Publication Data

US 2017/0022437 A1 Jan. 26, 2017

(51) Int. Cl.
*C10L 1/32* (2006.01)

(52) U.S. Cl.
CPC ..... *C10L 1/322* (2013.01); *C10L 2200/043* (2013.01); *C10L 2200/0438* (2013.01); *C10L 2230/14* (2013.01); *C10L 2250/06* (2013.01); *C10L 2290/08* (2013.01); *C10L 2290/24* (2013.01); *C10L 2290/28* (2013.01); *C10L 2290/34* (2013.01)

(58) Field of Classification Search
CPC ..... C10L 1/322; C10L 2200/0438; C10L 2250/06; C10L 2290/24; C10L 2290/34; C10L 2290/28
See application file for complete search history.

(56) References Cited

U.S. PATENT DOCUMENTS 1,329,493 A * 2/1920 Bacon ..... B03D 1/02 209/166
2,590,733 A * 3/1952 Stillman ..... C10L 1/322 44/282
2,754,267 A 7/1956 Bondi
3,327,402 A 6/1967 Lamb et al.
4,090,853 A 5/1978 Clayfield et al.
4,239,426 A 12/1980 Nakabayashi et al.
4,251,229 A 2/1981 Naka et al.
4,265,637 A 5/1981 Anderson
(Continued)

FOREIGN PATENT DOCUMENTS

CA 1096620 A 3/1981
DE 3130662 A1 2/1983
(Continued)

OTHER PUBLICATIONS

Great Britain Search Report pertaining to application No. GB1607557.4 dated Oct. 13, 2016.
(Continued)

*Primary Examiner* — Cephia D Toomer
(74) *Attorney, Agent, or Firm* — Dinsmore & Shohl LLP

(57) ABSTRACT

This document relates to a fuel oil composition comprising: (i) a solid hydrocarbonaceous and/or solid carbonaceous material, wherein the material is in particulate form, and wherein at least about 90% by volume (% v) of the particles are no greater than about 20 microns in diameter; and (ii) a liquid fuel oil; wherein the solid hydrocarbonaceous and/or solid carbonaceous material is present in an amount of at most about 30 by mass (% m) based on the total mass of the fuel oil composition. The invention further relates a process for the preparation of this fuel oil composition, a method of changing a grade of a liquid fuel oil, and a method for adjusting the flash point of a liquid fuel oil.

20 Claims, 4 Drawing Sheets

(56) References Cited

U.S. PATENT DOCUMENTS

| | | | | |
|---|---|---|---|---|
| 4,282,004 | A | 8/1981 | Masologites | |
| 4,330,300 | A * | 5/1982 | Cairns | C10L 1/322 44/282 |
| 4,389,219 | A | 6/1983 | Naka et al. | |
| 4,396,397 | A | 8/1983 | Kugel et al. | |
| 4,417,901 | A | 11/1983 | Ando et al. | |
| 4,425,135 | A * | 1/1984 | Jenkins | C10L 1/322 208/426 |
| 4,459,762 | A | 7/1984 | Hardesty et al. | |
| 4,511,364 | A | 4/1985 | Mitsumori | |
| 4,537,599 | A | 8/1985 | Greenwald, Sr. | |
| 4,783,198 | A * | 11/1988 | Hueschen | C10L 1/326 44/280 |
| 4,859,209 | A | 8/1989 | Szabo nee Mogyorossi et al. | |
| 4,900,429 | A | 2/1990 | Richardson | |
| 5,096,461 | A | 3/1992 | Frankiewicz et al. | |
| 5,503,646 | A | 4/1996 | McKenny et al. | |
| 5,902,359 | A | 5/1999 | Grosso et al. | |
| 7,537,700 | B2 | 5/2009 | Kanda et al. | |
| 8,177,867 | B2 | 5/2012 | Joseph et al. | |
| 2011/0174696 | A1 | 7/2011 | Young et al. | |
| 2011/0239973 | A1* | 10/2011 | Qin | C10L 1/02 123/1 A |
| 2013/0152453 | A1 | 6/2013 | Baird et al. | |
| 2015/0184099 | A1 | 7/2015 | Swensen et al. | |
| 2016/0082446 | A1 | 3/2016 | Swensen et al. | |

FOREIGN PATENT DOCUMENTS

| | | | |
|---|---|---|---|
| EP | 0012606 | A1 | 6/1980 |
| JP | S5440808 | A | 3/1979 |
| JP | S54129008 | A | 10/1979 |
| JP | S5636589 | A | 4/1981 |
| JP | S62172093 | A | 7/1987 |
| JP | S6348396 | A | 3/1988 |
| JP | 2000290673 | A | 10/2000 |

OTHER PUBLICATIONS

Cui et al., "A Novel Process for Preparation of an Ultra-Clean Superfine Coal-Oil Slurry", Fuel, 2008, 87, 2296-2303.

Shaver, Robert G., "A Solvent-Refined Coal Process for Clean Utility Fuel", Advances in Chemistry Series, 1974, 127, 89-90.

* cited by examiner

FUEL OIL COMPOSITIONS AND PROCESSES

CROSS-REFERENCE TO RELATED APPLICATIONS

This application claims the benefit of UK patent application GB 1605768.9 filed Apr. 4, 2016 and UK patent application GB 1607557.4 filed Apr. 29, 2016.

BACKGROUND OF THE INVENTION

The invention is in the field of combination products derived from solid hydrocarbonaceous and/or solid carbonaceous material with liquid hydrocarbons, particularly the combination of coal with fuel oil, in order to create a combined product that may be used as a fuel. In particular, the invention is in the field of introduction of solid hydrocarbons, such as coal, into fuel oil in order to upgrade the solid hydrocarbon and replace a proportion of the fuel oil.

Coal fines and ultrafines, including microfines are small particles of coal generated from larger lumps of coal during the mining and preparation process. While coal fines retain the same energy potential of coal they are generally considered a waste product as the particulate nature of the product renders it difficult to market and transport. Coal fines are therefore generally discarded as spoil close to the colliery forming large waste heaps that require careful future management in order to avoid environmental contamination or even the threat to human life as demonstrated in the 1966 Aberfan disaster in South Wales.

Nevertheless, coal fines do offer a cheap and plentiful supply of hydrocarbons particularly rich in carbon. It is known to add slurries of coal fines in water to fuel oils in order to upgrade the coal fine product and reduce the cost per unit volume of the blended fuel oil (see for example U.S. Pat. Nos. 5,096,461, 5,902,359 and 4,239,426). However, in its natural state, coal fines typically contain significant levels of ash-forming components that would render it unsuitable for blending directly with fuel oil. Furthermore, the amount of water present in coal fines (ca. 35% by mass or % m) is also undesirable for use in fuel oil. Selecting coal fines with low mineral matter content is one possibility for ameliorating these problems. Suitable coal fines can be manufactured by crushing and grinding seam coal with inherently low mineral matter content (e.g. <5% m), however, this limits quite substantially the types of coal that can be utilised.

There has been previous research into methods of converting coal into liquid hydrocarbon products: these mainly involve solvent extraction of coal at temperatures above 400° C. under pressure in the presence of hydrogen or a hydrogen donor solvent, e.g. tetralin (1,2,3,4-tetrahydronaphthalene). This has led to several pilot scale developments and at least one full-scale operating plant using the Shenhua process at Ejin Horo Banner, Ordos, Inner Mongolia, China. Exploitation of this process involves, however, a very large capital investment and high associated running costs.

Fuel oil is a higher distillate product derived from crude oil. The term "fuel oil" covers a range of petroleum grades having a boiling point higher than that of gasoline products. Typical fuel oils are residual fuel oils (RFOs) and marine fuel oils (MFOs).

Fuel oil is classed as a fossil fuel and is a non-renewable energy source. Furthermore, while crude oil prices are quite volatile the refined products that are obtained therefrom are always relatively expensive. A way in which fuel oil could be blended with a lower cost hydrocarbon source such as coal, to extend the finite reserves of crude oil, and the resultant refined distillate products, would be highly desirable.

These and other uses, features and advantages of the invention should be apparent to those skilled in the art from the teachings provided herein.

U.S. Pat. No. 2,590,733 and DE3130662 refer to use of RFO-coal dispersions for burners/boilers designed for the use of RFO. As for U.S. Pat. Nos. 4,265,637, 4,251,229, 4,511,364, JPS5636589, JPS6348396, DE3130662, U.S. Pat. Nos. 5,503,646, 4,900,429 and JPS2000290673, U.S. Pat. No. 2,590,733 and DE3130662 utilise coarse particle sizes in the pulverised coal range (<200 microns, or <200 μm) or even larger which would not be suitable for passing through fuel filters.

U.S. Pat. Nos. 4,417,901 and 4,239,426 focus on much higher coal loadings: 30-70%.

U.S. Pat. Nos. 5,096,461, 5,902,359, 4,511,364 and JPS2000290673 relate specifically to coal-oil-water dispersions.

U.S. Pat. Nos. 4,389,219, 4,396,397, 4,251,229, JPS54129008 and JPS5636589 include or specify stabilising additives which may move the properties of the resultant fuel oil-coal blend out of specification.

U.S. Pat. No. 4,090,853A and CA 1096620 A1, plus Clayfield, E. et al., Colloil manufacture and application (Fuel, 1981, 60, 865) relate specifically to coarser particles (<500 μm) suspended in fuel oil and water.

U.S. Pat. No. 8,177,867 B2 and Nunez, G. A. et al., Colloidal coal in water suspensions (Energy and Environmental Science, 2010 3(5), 629) relate specifically to colloidal coal-in-water slurries with 20-80% particles<1 micron size.

SUMMARY OF THE INVENTION

Accordingly, in a first aspect the invention provides a fuel oil composition comprising:

(i) solid hydrocarbonaceous and/or solid carbonaceous material, wherein the material is in particulate form, and wherein at least about 90% by volume (% v) of the particles are no greater than about 20 μm (microns) in diameter; and (ii) a liquid fuel oil, wherein the solid hydrocarbonaceous and/or solid carbonaceous material is present in an amount of at most about 30% m (thirty percent by mass) of the total mass of the fuel oil composition.

Typically the solid hydrocarbonaceous and/or solid carbonaceous material comprises coal; optionally the coal is microfine coal which comprises particles in which typically at least 95% v of the particles, optionally 98% v, suitably 99% v are no greater than about 20 μm in diameter.

According to a specific embodiment of the invention the solid hydrocarbonaceous and/or solid carbonaceous material is dewatered prior to combination with the liquid fuel oil.

In another embodiment of the invention, the solid hydrocarbonaceous and/or solid carbonaceous material is subjected to a de-ashing step prior to combination with the liquid fuel oil.

In an alternative embodiment of the invention, the solid hydrocarbonaceous and/or solid carbonaceous material comprises a dewatered ultrafine coal preparation that comprises a low inherent ash content.

Where the solid hydrocarbonaceous and/or solid carbonaceous material comprises microfine coal, suitably the ash content is less than about 20% m of the coal preparation;

optionally less than about 15% m, suitably less than about 10% m, or less than about 5% m, or less than about 2% m, or less than 1% m.

According to a specific embodiment of the invention, the liquid fuel oil is selected from one of the group consisting of: marine diesel, diesel and kerosene for stationary applications, marine bunker oil; residual fuel oil; and heavy fuel oil. Suitably the liquid fuel oil conforms to, or is defined by, the main specification parameter included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Alternatively, the liquid fuel oil conforms to the main specification parameters included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Suitably the liquid fuel oil conforms to the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards.

In embodiments of the invention, the term "main specification parameter" refers to a parameter selected from the group consisting of: viscosity at 100° C.; viscosity at 50° C.; viscosity at 40° C.; density at 15° C.; ash content; sulphur content; water; sediment; flash point; and pour point.

In embodiments of the invention, the term "main specification parameters" refers to two or more parameters, suitably, 2, 3, 4, 5, 6, 7, 8, 9 or 10 parameters, selected from the group consisting of: viscosity at 100° C.; viscosity at 80° C.; viscosity at 50° C.; viscosity at 40° C.; density at 15° C.; ash content; sulphur content; water; sediment; flash point; and pour point.

In an embodiment of the invention the fuel oil composition comprising both solidhydrocarbonaceous and/or solid carbonaceous material and liquid fuel oil conforms to the main specification parameter included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Alternatively, the fuel oil composition comprising both solid hydrocarbonaceous and/or solid carbonaceous material and liquid fuel oil conforms to the main specification parameters included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Suitably, the fuel oil composition comprising both solid hydrocarbonaceous and/or solid carbonaceous material and liquid fuel oil conforms the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards.

According to a specific embodiment of the invention, the solid hydrocarbonaceous and/or solid carbonaceous material is present in an amount of at most about 20% m, suitably about 15% m, optionally about 10% m of the total mass of the fuel oil composition.

In one embodiment of the invention, the solid hydrocarbonaceous and/or solid carbonaceous material is present in an amount of at least about 0.01% m, suitably at least about 0.10% m, optionally about 1% m of the total mass of the fuel oil composition.

In a particular embodiment of the invention, the fuel oil composition comprises the solid hydrocarbonaceous and/or solid carbonaceous material in the form of a suspension. Typically the suspension is stable for at least 1 hour, optionally at least 24 hours, suitably at least 72 hours. In one embodiment of the invention the suspension is stable for more than 72 hours.

A second aspect of the invention provides a process for the preparation of a fuel oil composition comprising combining a solid hydrocarbonaceous and/or solid carbonaceous material, wherein the material is in particulate form, and wherein at least about 90% v of the particles are no greater than about 20 μm in diameter; and a liquid fuel oil, wherein the solid hydrocarbonaceous and/or solid carbonaceous material is present in an amount of at most about 30% m (30% by mass) of the total mass of the fuel oil composition.

In an embodiment of the second aspect of the invention, the solid hydrocarbonaceous and/or solid carbonaceous material is dispersed in the liquid fuel oil. Suitably, the dispersion is achieved by a method selected from the group consisting of: high shear mixing; ultrasonic mixing, or a combination thereof.

In an embodiment of the second aspect of the invention, the solid hydrocarbonaceous and/or solid carbonaceous material comprises coal.

In some embodiments of the second aspect of the invention, the solid hydrocarbonaceous and/or solid carbonaceous material is de-watered prior to combination with the liquid fuel oil. Optionally, the solid hydrocarbonaceous and/or solid carbonaceous material is subject to a de-mineralising/de-ashing step prior to combination with the liquid fuel oil. Suitably, the demineralisation is via a froth flotation technique.

In some embodiments of the process of the present invention, the solid hydrocarbonaceous and/or solid carbonaceous material is subjected to a particle size reduction step. Particle size reduction may be achieved by any appropriate method. Suitably, the particle size reduction is achieved by a method selected from the group consisting of: milling, grinding, crushing, high shear grinding or a combination thereof.

In an embodiment of the invention, the liquid fuel oil is selected from one of the group consisting of: marine diesel, diesel and kerosene for stationary applications, marine bunker oil; residual fuel oil; and heavy fuel oil. Alternatively, or in addition, the liquid fuel oil conforms to, or is defined by, the main specification parameter included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Alternatively, the liquid fuel oil conforms to the main specification parameters included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Suitably, the liquid fuel oil conforms to the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards A third aspect of the invention comprises a method for changing the grade of a liquid fuel oil comprising adding to the fuel oil a solid hydrocarbonaceous and/or solid carbonaceous material, wherein the material is in particulate form, and wherein at least about 90% v of the particles are no greater than about 20 μm in diameter. Suitably the grade of the liquid fuel oil is defined by the main specification parameter included in one or more of the fuel oil standards selected from the group consisting of: ISO 8217:2010; ISO 8217:2012; ASTM D975-14; ASTM D396; BS 2869:2010; GOST10585-99, GOST10585-75 and equivalent Chinese standards. Alternatively, the liquid fuel oil is defined by the main specification parameters included in one or more of the fuel oil standards selected from the group consisting of: ISO 8217:2010; ISO 8217:2012; ASTM D975-14; ASTM D396; BS 2869:2010; GOST10585-99, GOST10585-75 and equivalent Chinese standards. Suitably, the liquid fuel oil is defined by the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards.

It will be appreciated that the features of the invention may be subjected to further combinations not explicitly recited above.

BRIEF DESCRIPTION OF THE DRAWINGS

The invention is further illustrated by reference to the accompanying drawings in which.

DETAILED DESCRIPTION OF THE INVENTION

Figure 1:
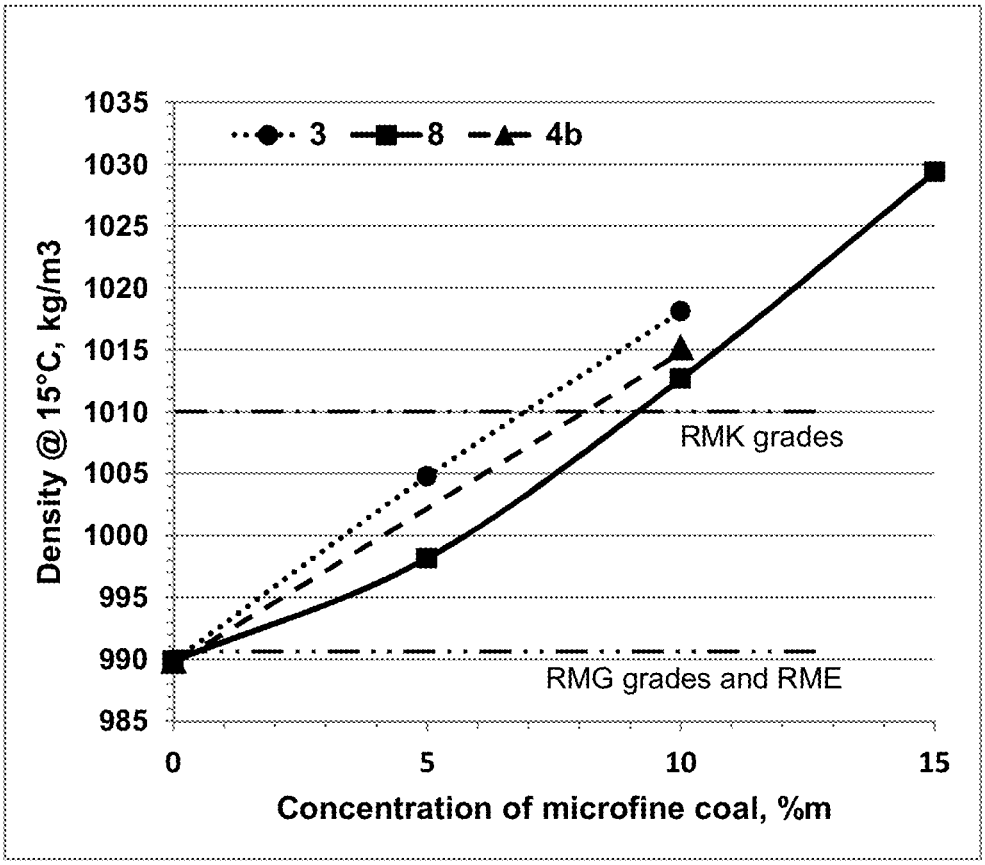
FIG. 1 shows the relationship between density and microfine coal concentration for RFO-coal blends.

All references cited herein are incorporated by reference in their entirety. Unless otherwise defined, all technical and scientific terms used herein have the same meaning as commonly understood by one of ordinary skill in the art to which this invention belongs.

The invention relates, in a specific embodiment, to preparing and blending de-mineralised, de-watered/dehydrated coal powder, commonly termed in the industry "fines", suitably selected from "microfines" (typical particle size <20 μm), with fuel oil to produce a combined blended product. The inventive concept further extends to the uses of the blended fuel oil product, including preparing fuels based on blended fuel oil products.

Prior to further setting forth the invention, a number of definitions are provided that will assist in the understanding of the invention.

As used herein, the term "comprising" means any of the recited elements are necessarily included and other elements may optionally be included as well. "Consisting essentially of" means any recited elements are necessarily included, elements that would materially affect the basic and novel characteristics of the listed elements are excluded, and other elements may optionally be included. "Consisting of" means that all elements other than those listed are excluded. Embodiments defined by each of these terms are within the scope of this invention.

The term "coal" is used herein to denote readily combustible sedimentary mineral-derived solid solid carbonaceous material including, but not limited to, hard coal, such as anthracite; bituminous coal; sub-bituminous coal; and brown coal including lignite (as defined in ISO 11760:2005 and in equivalent Chinese standards).

The definition of a fuel oil varies geographically. As used herein, fuel oils may relate to:

- Residue-containing burner fuels, middle distillate fuels for stationary applications and kerosene-type burner fuels, as defined in BS 2869:2010+A1:2011, Fuel oils for agricultural, domestic and industrial engines and boilers—Specification, and in equivalent Chinese standards;
- Fuel oil grades intended for use in various types of fuel-oil-burning equipment under various climatic and operating conditions as specified in ASTM D396-15c, Standard Specification for Fuel Oils, in GOST standards 10585-99 and 10585-75, and in equivalent Chinese standards;
- Diesel Fuel Oil Grade No. 4-D for use in low- and medium-speed diesel engines in applications necessitating sustained loads at substantially constant speed as defined in ASTM D975-14, Standard Specification for Diesel Fuel Oils, and in equivalent Chinese standards; and
- Marine residual fuel oils (RFO) and marine distillate fuels as specified in ISO 8216-1:2010 Petroleum products. Fuels (class F) classification. Part 1: Categories of marine fuels and ISO 8217:2012 Petroleum products. Fuels (class F). Specifications of marine fuels, and in equivalent Chinese standards.

Equivalent grades to the above fuel oils as specified may be used in other countries worldwide.

As used herein, the term "ash" refers to the inorganic—e.g. non-hydrocarbon—component found within most types of fossil fuel, especially that found in coal. Ash is comprised within the solid residue that remains following combustion of coal, sometimes referred to as fly ash. As the source and type of coal is highly variable, so is the composition and chemistry of the ash. However, typical ash content includes several oxides, such as silicon dioxide, calcium oxide, iron (III) oxide and aluminium oxide. Depending on its source, coal may further include in trace amounts one or more substances that may be comprised within the subsequent ash, such as arsenic, beryllium, boron, cadmium, chromium, cobalt, lead, manganese, mercury, molybdenum, selenium, strontium, thallium, and vanadium.

As used herein the term "de-ashed coal" refers to coal that has a proportion of ash-forming components that is lower than that of its natural state. The related term "demineralised coal" is used herein to refer to coal that has a reduced proportion of inorganic minerals compared to its natural state. The terms "de-ashed coal" and "demineralised coal" may also be used to refer to coal that has a low naturally-occurring proportion of ash-forming components, or minerals respectively, as may the term "low ash coal".

As used herein, the term "coal fines" refers to coal in particulate form with a maximum particle size typically less than 1.0 mm. The term "coal ultrafines" or "ultrafine coal" or "ultrafines" refers to coal with a maximum particle size typically less than 0.5 mm. The term "coal microfines" or "microfine coal" or "microfines" refers to coal with a maximum particle size typically less than 20 μm.

The term "pulverised coal" as used herein refers to a coal that has been crushed to a fine dust. The particle size is generally large in the order of <200 μm with wide distribution that lacks uniformity.

The term "hydrocarbonaceous material" as used herein refers to fossilised organic matter containing hydrocarbons; hydrocarbons being an organic compound consisting substantially of the elements hydrogen and carbon.

The term "carbonaceous material" as used herein refers to materials containing predominantly carbon, derived by pyrolysis of organic matter, and including coke, activated carbon and carbon black.

The term "carbon black" as used herein refers to finely divided forms of substantially pure elemental carbon prepared by the incomplete combustion or thermal decomposition of gaseous or liquid hydrocarbons, especially petroleum products.

The term "activated carbon" as used herein refers to very porous carbon processed from materials like nutshells, wood, and coal by various combinations of pyrolysis and activation steps. Activation involves high temperature treatment of pyrolysed materials in the absence of air, either with steam, carbon dioxide, or oxygen, or following impregnation by certain specific acids, bases or salts.

The term "dispersant additive" as used herein refers to a substance added to a mixture to promote dispersion or to maintain dispersed particles in suspension.

As used herein, the term "water content" refers to the total amount of water within a sample, and is expressed as a concentration or as a mass percentage. When the term refers to the water content in a coal sample, it includes the inherent or residual water content of the coal, and any water or moisture that has been absorbed from the environment. As used herein the term "dewatered coal" refers to coal that has a proportion of water that is lower than that of its natural state. The term "dewatered coal" may also be used to refer to coal that has a low naturally-occurring proportion of water.

Fuel oil is expensive and is a non-renewable source of energy. Coal-fines are generally regarded as a waste product and are available cheaply in plentiful supply. The problem addressed by the present invention is to provide a blended fuel oil that is cheaper than current alternatives, yet still meet required product and emission criteria to enable its use in burners and boilers designed for fuel oil. Non-automotive use of fuel oil includes boilers and engines both for marine use and stationary applications, such as power stations and industrial, commercial and residential use. These fuels are now tightly specified to protect more sophisticated burner and boiler equipment controls are also needed to limit boiler emissions. Different specifications apply for the range of technologies and these may vary according to the region or country of use. The main parameters from some of some widely used specifications are shown below in Tables 1a, 1b and 1c. This includes details for international trading specifications for Heavy Fuel Oil used in China (S&P Global Platts Methodology and Specifications Guide: China Fuel Oil).

Mineral matter content is controlled in most fuel oil grades by specifying the ash content. The limits for ash content for these fuel oil grades vary from 0.01% m (marine distillate fuel oil) to 0.15% m (Marine RFO grade RMK and ASTM D396 Heavy fuel oil No. 5). The proportion of a microfine coal (e.g. one with 1% m ash content) that can be added to fuel oil and remain within specifications can vary considerably therefore from <1% m in marine distillate fuel oil (also known as marine diesel) to <15% m in ASTM D396 HFO No. 5, and is unconstrained in ASTM D396 HFO No. 6. For the purposes of these calculations, the ash content of the fuel oil is assumed to be close to zero. It is therefore important to demineralise the microfine coal as effectively as possible.

In view of the above, there exists a technical prejudice in the mind of the skilled person against using coal in fuel oils due to the perceived abundance of mineral matter in most coals.

TABLE 1a

Typical limits for the main specification parameters of various fuel oil grades
MARINE FUEL OIL GRADES
ISO 8217:2010 Marine or Bunker RFO grades

| | | | RMA | RMB | RMD | RME | RMG | | | | RMK | | |
|---|---|---|---|---|---|---|---|---|---|---|---|---|---|
| | | | 10 | 30 | 80 | 180 | 180 | 380 | 500 | 700 | 380 | 500 | 700 |
| Viscosity @ 50° C. | $mm^2/s$ | max | 10 | 30 | 80 | 180 | 180 | 380 | 500 | 700 | 380 | 500 | 700 |
| Density @ 15° C. | $kg/m^3$ | max | 920 | 960 | 975 | 991 | 991 | | | | 1010 | | |
| Ash content | % m | max | 0.04 | | 0.07 | | 0.1 | | | | 0.15 | | |
| Sulphur content content | % m | max | Emission Control Areas <0.1% Globally: In transition from 3.5% to 0.5% by 2020 subject to 2018 review | | | | | | | | | | |
| Water | % m | max | 0.3 | | | | 0.5 | | | | | | |
| Flash Point | ° C. | min | 60 | | | | | | | | | | |

ISO 8217:2010 Marine or Bunker distillate fuel oil grades

| | | | DMX | DMA | DMZ | DMB |
|---|---|---|---|---|---|---|
| Viscosity @ 40° C. | $mm^2/s$ | max | 5,500 | 6,000 | | 11,000 |
| | | min | 1,400 | 2,000 | 3,000 | 2,000 |
| Density @ 15° C. | $kg/m^3$ | max | — | 890 | 890 | 900 |
| Ash content | % m | max | 0.01 | | | |
| Sulphur content | % m | max | 1.0 | 1.5 | | 2.0 |
| Water | % m | max | — | | | 0.3 |
| Flash Point | ° C. | min | 43 | | 60 | |

TABLE 1b

Typical limits for the main specification parameters of stationary combustion fuel oil grades
STATIONARY COMBUSTION FUEL OIL GRADES

| | | | BS 2869 | | | | | | | ASTM 396 Heavy Fuel Oil grades | | | | |
|---|---|---|---|---|---|---|---|---|---|---|---|---|---|---|
| | | | Kerosene grades | | Diesel | RFO burner grades | | | | | | | | |
| | | | Class | | | | | | | No. 4 | No. | No. 5 | No. 5 | No. |
| | | | C1 | C2 | D | E | F | G | H | Light | 4 | Light | Heavy | 6 |
| Viscosity | $mm^2/s$ | min | | 1.0 | 1.5 | | — | | | 1.9 | >5.5 | | — | |
| @ 40° C. | | max | | 2.0 | 5.0 | | — | | | 5.5 | 24 | | — | |
| Viscosity | $mm^2/s$ | min | | | | — | 8.201 | 20.01 | 40.01 | | | 5.0 | 9.0 | 15.0 |
| @ 100° C. | | max | | | | 8.20 | 20.00 | 40.00 | 56.00 | | | 8.9 | 14.9 | 50.0 |
| Density | $kg/m^3$ | min | | 750 | 820 | | | | | 878 | | | — | |
| @ 15° C. | | max | | 840 | | | | | | | | — | | |
| Ash content | % m | max | | | 0.01 | 0.10 | | 0.15 | | 0.05 | 0.10 | 0.15 | 0.15 | — |
| Sulphur content | % m | max | 0.04 | 0.1 | 0.1 | | 1.0 | | | | | — | | |
| Water | % m | max | | | 0.02 | 0.5 | 0.75 | 1.0 | | | | | | |
| Water & sediment | % m | max | | | | | — | | | 0.5 | | 1.0 | | 2.0 |
| Flash Point | ° C. | min | 43 | 38 | 56 | | 66 | | | 38 | | 55 | | 60 |

TABLE 1c

Typical limits for the main specification parameters of various fuel oil grades
International Trading Specifications for Heavy Fuel Oil used in China

| | | | Domestic | | Imported Grades | | | Mazut M-100 GOST |
|---|---|---|---|---|---|---|---|---|
| | | | Grades | Cracked | Straight-run | | Cracked | 10585-99[1] |
| Sulphur content | % m | max | 1.5 | 2.5 | 1.5 | 2.5 | 3.5 | [2] |
| Viscosity @ 50° C. | $mm^2/s$ | max | | | 180 | | | n.a. |
| Viscosity @ 80° C. | | max | | | | | | 118 |
| Viscosity @ 100° C. | | max | | | | | | 50 |
| Density @ 15° C. | $kg/m^3$ | max | 980 | 985 | | 980 | | 890-920 |
| Ash content | % m | max | | | 0.10 | | | [3] |
| Sediment | % m | max | | | 0.10 | | | 1.0 |
| Water | % m | max | 1.0 | 0.5 | 2.0 | 1.0 | 0.5 | 1.0 |
| Pour Point | ° C. | max | 24 | 20 | | 24 | | 25[4] |
| Flash Point | ° C. | min | 60 | | 66 | | | 65 |

[1]GOST standard 10585-75 is also still used in trading. This contains some added specification parameters shown in italics.
[2]7 grades are specified based on sulphur content:
I: <0.5% m, II: <1.0% m, III: <1.5% m, IV: <2.0% m, V: <2.5% m, VI: <3.0% m, VII: <3.5% m.
[3]2 grades: low-ash: <0.05% m, more ash: <0.14% m
[4]Referred to as temperature of solidification The limits for water content vary from 0.3% m (e.g. Marine RFO grade RMA) to 1% m (UK BS 2869 RFO burner fuel grades G and H). ASTM D396 specifies water plus sediment and the most viscous HFO grade No. 6 has a limit of 2% m for water plus sediment. The proportion of a microfine coal (e.g. one with 2% m water content) that can be added to fuel oil and remain within specifications can vary considerably therefore from <15% m in Marine RFO grade RMA to <50% m in UK BS 2869 RFO burner fuel grades G and H. It is therefore important to dewater the coal as effectively as possible.

In view of the above, the skilled person would be dissuaded from considering inclusion of coal in fuel oils due to the need to keep water content low, amongst other considerations.

The proportion of a microfine coal (e.g. one with 0.5% m sulphur content) that can be added to fuel oil is only constrained by those fuel oil specifications with sulphur content limits of below 0.5% m.

Most fuel oil specifications allow sulphur content at 1% m or higher; in these cases microfine coal addition is a benefit and will reduce fuel sulphur content and the associated sulphur oxides emitted from combustion devices using fuel oil containing microfine coal. For the fuel oil specifications shown below, the level of microfine coal addition is only limited by sulphur content in Marine RFO supplied in Emission Control Areas, and in this case to <20% m.

Upgrading coal fines by blending with fuel oil is known when the coal fines are in their natural state. However, in their natural state, coal fines typically contain levels of ash-forming components and sulphur that would render them unsuitable for blending with fuel oils which must meet set current fuel oil specifications and emissions limits to operate efficiently in burners and boilers designed for fuel oil. Furthermore, the amount of water present in coal fines (ca. 35% m) and high mineral matter content is also undesirable for use in fuel oils.

To date, it has not been possible to produce economically a coal-fuel oil blend which can meet fuel oil specifications requiring very low mineral matter content and particle sizes predominantly <10 μm (preferably mainly <2 μm) i.e. much smaller than the 500 micron upper limit associated with "ultrafine" coal.

Hitherto published information regarding dispersion of coal fines in fuel oil has not addressed fitness for use in fuel oil boilers, but at reducing spontaneous combustion risks, especially for lignite, simplifying transportation via improved pumpability, and improving combustion in coal-fired boilers, often via the use of fuel-water emulsions containing coal and fuel oil.

Recent developments processing of coal fines have made available a microfine coal product that has a low water content (<15% m, preferably <3% m) and a low ash content (<10% m, preferably <2% m). The process of demineralisation also has a beneficial effect on sulphur content via removal of iron pyrites. Demineralising and dewatering of coal fines is typically achieved via a combination of froth flotation separation, specifically designed for ultrafines and microfine particles, plus mechanical and thermal dewatering techniques. A typical process for the production of de-watered coal ultrafines is provided in US2015/0184099, which describes a vibration-assisted vacuum dewatering process. De-watered coal fines may also be provided as a cake comprising coal fine particles in a hydrocarbon solvent, water having been removed through the use of one or more hydrophilic solvents. Reduction of mineral ash content in coal fines is described, for example, in U.S. Pat. No. 4,537,599, US 20110174696 A1, US2016/082446 and Osborne D. et al., Two decades of Jameson Cell installations in coal, (17th International Coal Preparation Congress, Istanbul, 1-6 Oct. 2013).

Alternatively, certain coal seams produce coal that have a suitable ash, and potentially water content. Suitable treatment of this coal to produce coal fines of the required particle size would also be suitable for the invention.

It has surprisingly been found that dewatered, demineralised coal microfines product is particularly suitable for providing a blended fuel oil which can still meet the required specifications for use in stationary and marine boilers designed for fuel oil, by having an acceptable level of water, mineral matter, sulphur and particle size.

The present invention blends (i.e. suspends or disperses) the solid particulate matter of demineralised, de-watered/dehydrated microfine coal in fuel oil. This not only upgrades the coal fine product and reduces the overall cost of the heavy fuel oil, but also maintains desirable emission characteristics (i.e. low ash, low sulphur emissions) and satisfactory boiler operability. The amount of microfine coal that may be blended with the fuel oil is typically determined by the content of ash-forming components, water and sulphur in the microfine coal. The concept has been demonstrated with blends of 10% m coal microfines in residual fuel oils. The amount of blended coal fines may be well in excess of 10% m of the blend, for example up to 30% m, 40% m, 50% m, 60% m or more.

Due to the fine particulate nature of the microfine coal, it has been found that there is no significant settling of the solids on long-term storage, more than several months, at ambient temperatures. The particles may also pass through filters employed in systems that utilise fuel oils such as residual fuel oils, marine diesel, diesel heating fuel and kerosene heating fuel.

Any particle size of coal fines that is suitable for blending with fuel oil is considered to be encompassed by the invention. Suitably, the particle size of the coal fines is in the ultrafine range. Most suitably the particle size of the coal fines is in the microfine range. Specifically, the maximum average particle size may be at most about 50 μm. More suitably, the maximum average particle size may be at most around 40 μm, 30 μm, 20 μm, 10 μm, or 5 μm. The minimum average particle size may be 0.01 μm, 0.1 μm, 0.5 μm, 1 μm, 2 μm, or 5 μm.

An alternative measure of particle size is to quote a maximum particle size and a percentage value or "d" value for the proportion by volume of the sample that falls below that particle size. For the present invention any particle size of coal fines that is suitable for distillation with crude oil is considered to be encompassed by the invention. Suitably, the particle size of the coal fines is in the ultrafine range. Most suitably the particle size of the coal fines is in the microfine range. Specifically, the maximum particle size may be at most around 50 μm. More suitably, the maximum particle size may be at most about 40 μm, 30 μm, 20 μm, 10 μm, or 5 μm. The minimum particle size may be 0.01 μm, 0.1 μm, 0.5 μm, 1 μm, 2 μm, or 5 μm. Any "d" value may be associated with these particle sizes. Suitably, the "d" value associated with any of the above maximum particle sizes may be d99, d98, d95, d90, d80, d70, d60, or d50.

Preparing dewatered, low ash coal particles having an average particle size of <5 μm ready for dispersion into fuels, requires the combination of froth flotation, crushing, grinding and blending steps. The procedure may differ depending on whether the source is a coal fines deposit or a production coal. For coal fines deposits, coarse grinding may precede froth flotation that, in turn, is followed by wet fine grinding of coal to sizes significantly below industry norms, prior to the dewatering steps. For low ash production wet coal, crushing and coarse grinding also need to be followed by wet grinding techniques not commonly used for coal, with final dewatering. For low-ash coal with a low, in situ moisture content, crushing and grinding can be carried out dry, followed by minimal or no water removal.

This technology upgrades the coal fines product. The overall cost of the crude oil is reduced as is the amount of crude oil per unit of distillate product.

The amount of microfine coal that may be blended with the crude oil is at least 1 wt %, suitably at least 5 wt %, typically around 10 wt %, at most 70 wt %, suitably at most 60 wt %, optionally at most 50 wt %.

The invention is further illustrated by the following non-limiting examples.

EXAMPLES

Example 1a

Demineralising and Dewatering of Coal Fines may be Achieved Via a Combination of Froth Flotation Separation, Specifically Designed for Ultra Fines and Microfine Particles, Plus Mechanical and Thermal Dewatering Techniques The coal slurry is screened, collected in a tank and froth flotation agents are added using controlled dose rates. Micro particle separators filled with process water and filtered air from an enclosed air compressor are used to sort hydrophobic carbon materials from hydrophilic mineral materials. Froth containing carbon particles overflows the tank and this froth is collected in an open, top gutter. The mineral pulp is retained in the separation tank until discharged, whereas the demineralised coal slurry is de-aerated, before being pumped to the pelletisation step. Further coal particle size reduction may be achieved, if necessary, by various known milling techniques, including ones where a hydrocarbon oil is used as a milling aid.

Mechanical dewatering of the demineralised microfine coal slurry is carried out via a rotary vacuum drum filter or filter press. The resultant microfine coal wet-cake may be dried thermally or mechanically to a powder form or pelletized before drying. For pelletisation, a specific modifier is added to the filter cake in a mixer to optimize pelletisation and the modified cake is transported to an extruder where it is compressed into pellets. The demineralised coal pellets are then dried thermally by conveying them via an enclosed conveyor belt and a bucket elevator into a vertical pellet dryer where oxygen-deprived hot process air is blown directly through the microfine coal pellets.

Example 1b

Obtaining Coal Micro Fines by Grinding Larger Lumps and Particles of Coal in Wet Media The type of coal may be selected based on favourable properties of the coal such as low ash or water content or ease of grindability (e.g. high Hardgrove Grindability Index). Coal microfines were obtained by a variety of standard crushing and grinding size reduction techniques in wet media followed by dewatering 1. Crushing to reduce production washed, wet coal (e.g. coal D or coal F, Table 4) from 50 mm or thereabouts to approximately 6 mm, e.g. via a high pressure grinding roller mill or jaw crusher: suitable equipment is manufactured by Metso Corporation, Fabianinkatu 9 A, PO Box 1220, FI-00130 Helsinki, FIN-00101, Finland or McLanahan Corporation, 200 Wall Street Hollidaysburg, Pa. 16648, USA.
2. Produce a wet <6 mm slurry and reduce to 40 μm with a suitable ball mill, rod mill or stirred media detritor: suitable equipment is manufactured by Metso Corporation.
3. Reduce the <40 μm slurry to <1 μm or thereabouts using a nanomill, either a peg mill or horizontal disc mill: suitable equipment is manufactured by NETZSCH-Feinmahltechnik GMBH, Sedanstraβe 70, 95100 Selb, Germany. Isamills can also be used to reduce particle size to <5 μm or lower by attrition and abrasion: these mills are widely available, but no longer in production.
4. Dewater from approximately 50% m to <20% m or thereabouts, with a tube press operating at high pressures through a membrane or a vertical plate pressure filter: suitable equipment is manufactured by Metso Corporation. Alternative dewatering methods include vibration assisted vacuum dewatering (described in US2015/0184099), and filter presses e.g. as manufactured by McLanahan Corporation.
5. Dewatering to <2% m by
   a. thermal drying, such as fluidised bed, rotary, flash or belt dryers: suitable equipment is manufactured by companies, such as ARVOS Group, Raymond Bartlett Snow Division. 4525 Weaver Pky. Warrenville, Ill. 60555, USA and Swiss Combi Technology GmbH, Taubenlochweg 1, 5606 Dintikon, Switzerland.
   b. solvent-dewatering techniques with alcohols, ethers or ketones as described for example in U.S. Pat. Nos. 3,327,402, 4,459,762 and 7,537,700.

Example 1c

Obtaining Coal Micro Fines by Grinding Larger Lumps and Particles of Coal in a Dry State Coal microfines were obtained by standard crushing, grinding and pulverising size reduction techniques in a dry state.

1. Crushing of dry, raw seam coal with a jaw crusher to <30 mm size.
2. Pulverising dried coal from <30 mm to <45 μm size or thereabouts using ball mills with classifiers or by using centrifugal attrition mill (e.g. Lopulco mill, which is widely available, if no longer manufactured): suitable equipment is manufactured by Loesche GmbH, Hansaallee 243, 40549 Düsseldorf, Germany and British Rema Process Equipment Ltd, Foxwood Close, Chesterfield, S41 9RN, U.K.
3. Reduction to <1 μm or thereabouts with an air microniser (or jet mill): suitable equipment is manufactured by British Rema.

Example 1d

Obtaining Micro Fine Coal-Fuel Oil Cake by Grinding Dry Coal with a Fuel Oil or Similar Oil Product A cake of microfine coal in fuel oil was obtained by grinding 4 kg dry coal (e.g. coal D, Table 4) with approximately 4 liters of fuel oil as the fluid medium in a Netzsch Laboratory Agitator Bead Mill "LabStar" apparatus. The particle size distribution of the coal particles in the fuel oil cake was obtained by laser scattering using the dilution method described in Example 5.

Example 2

Dispersion of Microfine Coal in Fuel Oil may be Achieved Via High-shear Mixing of Various Forms of Microfine Coal Dried microfine coal powder (e.g. coal samples 1, 3, 4b, 8 and 5 in Table 4) a dried pellet of microfine coal, or microfine coal mixed with hydrocarbon oil in the form of a cake, is de-agglomerated and dispersed in fuel oil using a high-shear mixer in a vessel and blended with an additive to aid dispersancy, if required. Optionally, the vessel may be fitted with an ultrasonic capability to induce cavitation to enhance de-agglomeration. Shear mixing is carried out either at ambient temperatures or for more viscous fuel oils at elevated temperatures typically up to 50° C. Suitable shear mixers are manufactured by Charles Ross & Son Co. 710 Old Willets Path, Hauppauge, N.Y. 11788, USA, Silverson Machines Inc., 355 Chestnut St., East Longmeadow, Mass. 01028, USA, Netzsch-Feinmahltechnik or British Rema.

This process will typically take place at: a distillation plant, oil depot or bunkering facility, power plant, or industrial process site. The resultant fuel oil/microfine coal dispersion may be stored in tanks with agitation and heating equipment, stable for several months at ambient temperatures, or for short periods at elevated temperatures. The product can also be delivered immediately to end-user's combustion equipment.

Example 3

Properties of Blends of Microfine Coal with Fuel Oil

Three fuel oils (two RFO samples and one marine distillate, i.e. marine diesel) have been blended with microfine coal samples and a set of analytical test results obtained for a range of specification parameters, see Table 2. Four microfine coal samples have been tested: samples 1, 3, 4b and 8, all derived from the same generic US low-volatile bituminous coal source. Results of characterisation tests are given in Table 2. The microfine coal samples differ primarily in terms of particle size and ash content:—

Sample 1 is highest in ash content (13.8% m);

Sample 4b has a slightly lower ash content (7.0% m) than sample 1;

Sample 3 has a much lower ash content (4.5% m) than sample 1, and average particle size of 6.42 μm;

Sample 8 is lowest in both ash content (1.6% m) and average particle size (3.0 μm).

TABLE 2

Characterisation test results for microfine coal samples (n.d. = not determined)

| Sample No. | | | 1 | 3 | 4b | 8 | 5 | D | F |
|---|---|---|---|---|---|---|---|---|---|
| Coal class | | | Low volatile bituminous | | | | High volatile bituminous | | |
| Country of Origin | | | USA | | | | | | Colombia |
| Ash content | dry basis | % m | 8.5 | 3.6 | 7.0 | 1.6 | 1.5 | 1.4 | 1.5 |
| Calorific Value | dry basis | Btu/lb | 13,500 | 14,860 | 14,590 | 15,050 | n.d. | 14,570 | 14,020 |
| | | MJ/kg | 31.4 | 34.6 | 33.6 | 35.0 | | 33.9 | 32.6 |
| Volatile Matter | dry, ash-free basis | % m | n.d. | 21.9 | 19.9 | 19.8 | 35.1 | 38.0 | 39.8 |
| Sulphur | dry basis | | 0.9 | n.d. | n.d. | 0.9 | n.d. | 0.6 | n.d. |
| Carbon | | | n.d. | 86.6 | | 86.6 | 83.3 | 80.0 | 79.1 |
| Hydrogen | | | | 4.8 | | 4.5 | 5.2 | 5.7 | 5.4 |
| Particle Size | Average diameter | μm | 8.5 | 6.4 | 4.1 | 3.0 | 2.2 | n.d. | n.d. |
| | <20 μm | %, vol | 99 | 99 | 100 | 100 | 100 | | |
| | <10 μm | %, vol | 82 | 84 | 96 | 99 | 99 | | |
| | <1 μm | %, vol | 7 | 9 | 16 | 23 | 30 | | |

Figure 2:
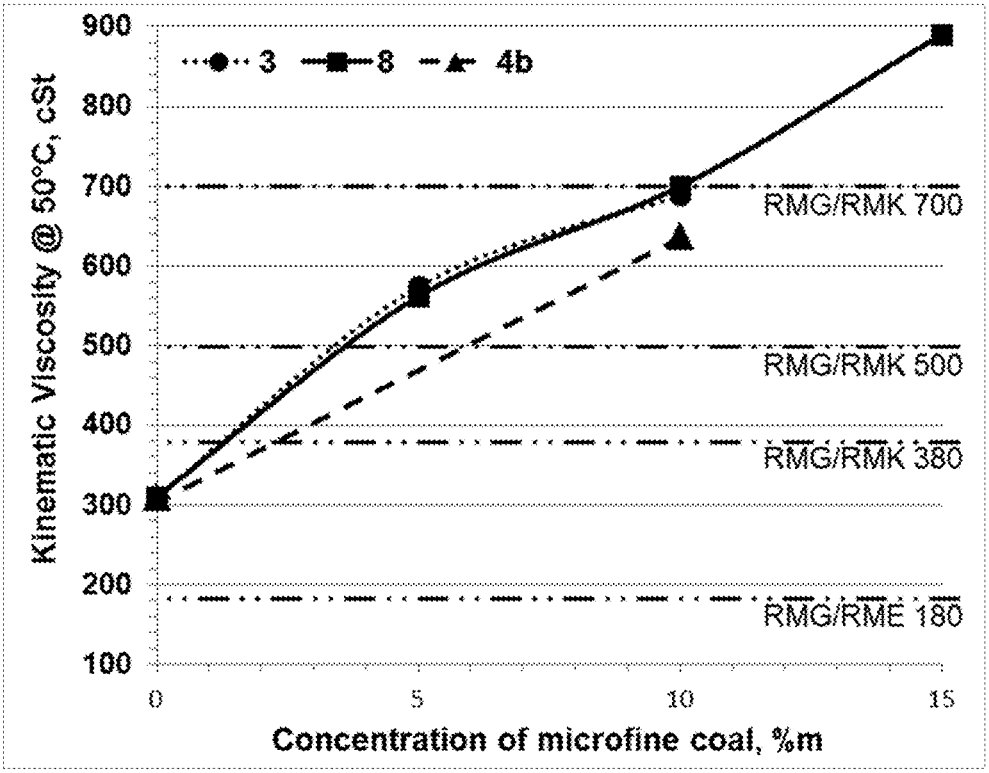
FIG. 2 shows the relationship between viscosity and microfine coal concentration for RFO-coal blends.
Figure 3:
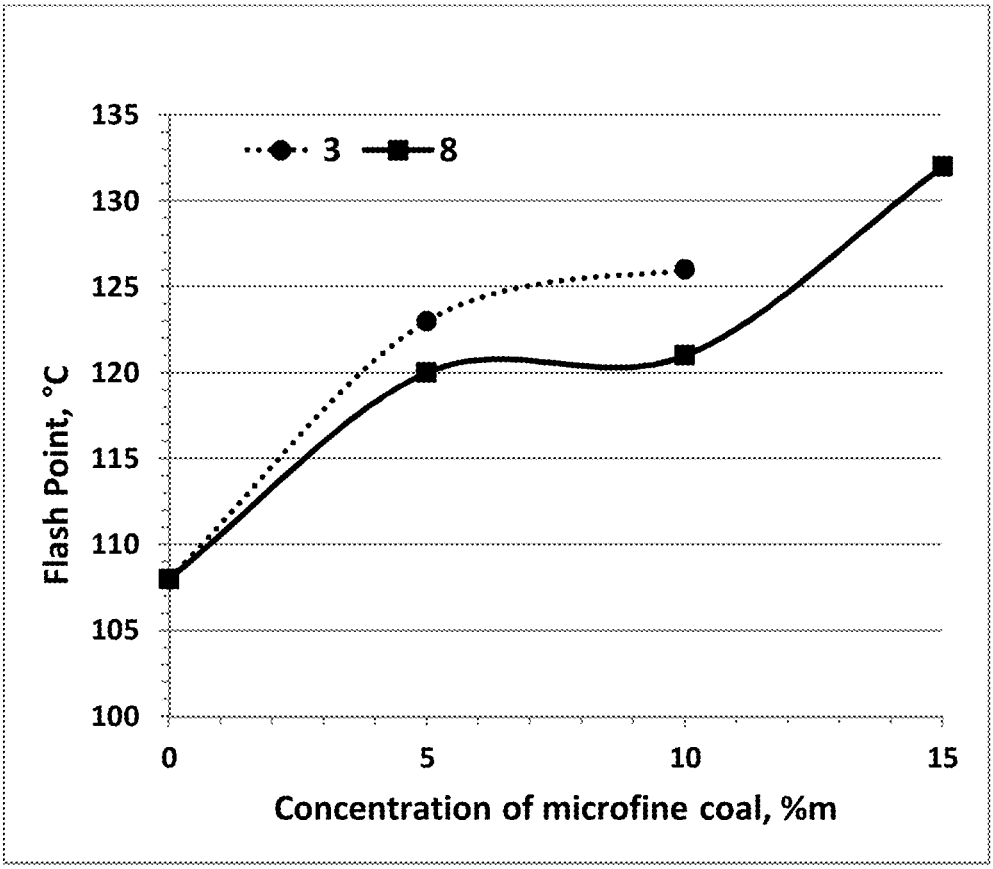
FIG. 3 shows the relationship between Flash Point and microfine coal concentration for RFO-coal blends.

An increase, both in density, FIG. 1, and in viscosity, FIG. 2, is observed from addition of all four microfine coal samples, Table 2. Density increases more rapidly for sample 3>sample 4b>sample 8; this corresponds to the order of increasing particle size. However, there is little difference in the rate of viscosity increase between samples 3 and 8, suggesting that reducing coal particle size from 6.4 μm to 3 μm has surprisingly little impact on viscosity. The viscosity increase for sample 4b is less than for the other two coals, and this may be attributable to the higher ash content of this coal.

FIGS. 1 and 2 also show the density and viscosity limits of various grades of marine RFO. The impact of the density and viscosity increases from microfine coal addition correspond approximately to the difference in density and viscosity between adjacent grades of fuel oil (Table 1). It has been surprisingly found that the addition of 10% m microfine coal only changes the fuel oil grade to the next heaviest fuel oil grade. Thus RFO-II, which is an RMK 380 grade, becomes RMK 700 on addition of 5% microfine coal 3 or microfine coal 8. As density exceeds 1010 kg/m$^3$ and viscosity exceeds 700 mm$^2$/s, the application of RFO-microfine coals to marine and stationary equipment becomes more limited and the rate that at which particular microfine coals increase density and viscosity may become more important than ash content in determining the maximum amount of microfine coal that can be accommodated in practice.

Although addition of microfine coal to RFO increases viscosity, unexpectedly and a positive finding is that the Pour Point of RFO was relatively unaffected by the addition of microfine coal, Table 3. Note that the repeatability and reproducibility of RFO Pour Point determination are 2.6° C. and 6.6° C. respectively, so a value of 3° C. or 9° C. is not significantly different to 6° C. Hence, neither samples 3 nor 4b significantly affected Pour Point at a concentration of 10% m. However, addition of 10% m and 15% m of the lowest particle size coal sample 8 did produce a slightly higher Pour Point of 12° C. Similarly the Pour Point of marine diesel was unaffected by the addition of 1% m microfine coal.

TABLE 3

Analytical test results for RFO, marine diesel and their blends with microfine coal (n.m. = not measureable, n.d. = not determined, all samples contain a fuel oil dispersant additive at low concentration)

| Test | Method | Units | | | | | | | | | | | |
|---|---|---|---|---|---|---|---|---|---|---|---|---|---|
| | | | | | | | | RFO-II | | RFO-I | | Marine Diesel | |
| Microfine Coal Sample No. | | | None | 3 | | 4b | | 8 | | None | 1 | None | 1 |
| Coal Concentration | | % m | | 5 | 10 | 10 | 5 | 10 | 15 | | 10 | | 1.0 |
| | | | | | | Density | | | | | | | |
| 60° C. | ASTM D4052 | kg/m$^3$ | | | | n.d. | | | | 970.0 | 997.6 | 845.3 | 846.0 |
| 15° C. | ASTM D4052 | | 989.9 | 1004.8 | 1018.1 | 1015.2 | 998.2 | 1012.7 | 1029.4 | 999.5 | 1026.9 | 876.2 | 876.9 |
| | | | | | | Kinematic Viscosity | | | | | | | |
| 50° C. | ASTM D445 | mm$^2$/s | 310 | 574 | 688 | 637 | 562 | 700 | 890 | 881 | 1128 | 2.905 | 2.909 |
| 100° C. | | | 35.7 | 44.9 | 56.3 | 54.0 | 47.8 | 58.3 | 79.7 | 60.2 | 104.4 | 1.359 | 1.356 |
| Sulphur | IP336 | % | 3.17 | | | | | n.d. | | | | | |
| Ash | ASTM D482 | % | <0.001 | | | | n.d. | | | | 1.43 | <0.001 | 0.022 |
| Pour Point | ASTM D97 | ° C. | 6 | 3 | 6 | 3 | 9 | 12 | 12 | 12 | 12 | −45 | −45 |
| Flashpoint | ASTM D93 | ° C. | 108 | 123 | 126 | n.d. | 120 | 121 | 132 | n.m. | 154 | 71 | 80 |
| Total Acid Number | ASTM D664 | mg KOH/g | 0.3 | 0.12 | 0.01 | | 0.03 | 0.35 | 0.26 | 0.782 | 0.791 | 0.031 | 0.035 |

TABLE 3-continued

Analytical test results for RFO, marine diesel and their blends with microfine coal (n.m. = not measureable, n.d. = not determined, all samples contain a fuel oil dispersant additive at low concentration)

| Test | Method | Units | | | RFO-II | | RFO-I | | Marine Diesel | |
|---|---|---|---|---|---|---|---|---|---|---|
| Copper Corrosion | ASTM D130 | rating | n.d. | n.d. | | 1A | 1A | 1A | 1A | |

Figure 4:
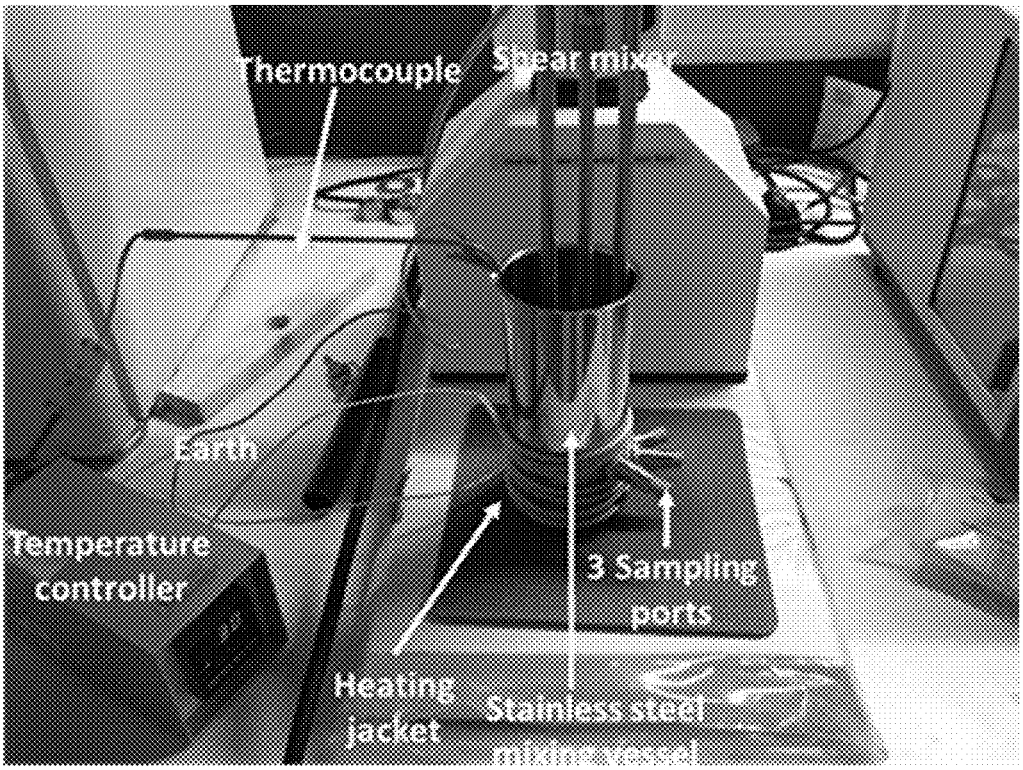
FIG. 4 shows a rig used to measure microfine coal dispersion in RFO.

The Flash Point of RFO and marine diesel is improved (i.e. higher value) by blending microfine coal with the base fuel, Table 3 and FIG. 4. Addition of 5% m of coal samples 3 or 8 increased the Flash Point of RFO-II by 15° C. and 12° C. respectively, with a further increase in Flash Points demonstrated for concentrations of 10% m of coal samples 3 or 8 and 15% m of coal sample 8. Similarly, the Flash Point is improved by 9° C. by adding just 1% m of microfine coal sample 1 (not shown). This ability to manipulate the flash-point of the blended coal-fuel oil may be useful in bringing the blend back into specification when the non-blended fuel oil falls outside. There are currently no fuel additives available commercially that can be used to adjust flash point in a predictable way.

The total acid number (TAN), a measurement of RFO acidity, can be improved by addition of microfine coal, Table 3, albeit consistent improvement is not observed from all the blends tested. In neither case did TAN deteriorate from microfine coal addition. On the one hand Coal 3 progressively reduced the RFO-II TAN value from 0.3 to 0.12 to 0.01 mg KOH/g fuel as concentration was increased from 0 to 5% m to 10% m. However a marked reduction in TAN by coal 8 at 5% m addition from 0.3 to 0.03 mg KOH/g fuel was followed by values of 0.5 and 0.26 mg KOH/g fuel at 10% m and 15% m respectively which are commensurate with that for the base fuel alone.

Example 4

Dispersion Stability of RFO-microfine Coal Blends

A stainless steel rig was designed for testing the dispersion of microfine coal samples in RFO, FIG. 4. Three ports were included to draw off samples @ 15, 30 & 45 cm above the base of the mixing vessel. The rig was preheated to 80° C., because the tested RFO was too viscous at 25° C. to disperse the microfine coal. Blends of 10% m air-dried microfine coal and RFO, plus a fuel oil dispersant additive were shear mixed at 8,000 to 9,000 rpm over different time intervals from 10 to 60 minutes, then left to stand at 80° C. for times between 1 hour and 7 days. Dispersed liquid was taken from each sampling port and filtered hot through a sinter to collect the solid material and the weight of solid material was weighed according to IP 375. The same concentration of solid in the top, middle & bottom samples is indicative of good dispersion. In some cases an additional measurement was made at the actual bottom of the mixing vessel. Results from a series of dispersion tests on blends of RFO II and coal sample 3 are given in Table 4.

The results demonstrate that dispersions of 10% m microfine coal in RFO can be produced. These dispersions are stable up to 4 days at an elevated temperature of 80° C. (test no. 10), if prepared by shear mixing with a dispersant additive for 60 minutes. Even after 7 days storage at 80° C., over 80% m of the particles in the blend remain dispersed (test no. 11). Shorter stability times of 24 hours were obtained if only 10 minutes mixing was carried out (tests 1-4).

The inclusion of a proprietary dispersant additive improves dispersion. The 2 days' storage experiment (test no. 8) was repeated without blending a dispersant additive (test no. 9). In the latter case a small, but significant, drop in the particle concentrations in top, middle and bottom layers was observed.

TABLE 4

Dispersion testing results on blends of microfine coal with RFO and marine diesel (n.d. = not determined, all test nos., except test no. 9, contain a fuel oil dispersant additive at low concentration) (numbers in bold signify that the dispersion has broken down)

| | RFO-II with 10% m microfine coal sample 3 | | | | | | | | | | | | Marine Diesel with 1% m microfine coal sample 1 | | |
|---|---|---|---|---|---|---|---|---|---|---|---|---|---|---|---|
| Mixing time | 10 min | | | | 30 min | | | | 60 min | | | | 20 min | | |
| Standing time | 60 min | 1 day | 2 days | 7 days | 1 hr | 1 hr | 1 day | 2 days | | 4 days | 7 days | 1 hr | 24 hr | 1 hr | 24 hr |
| Special condition | None | | | | | | | No dispersant additive | | | None | | | Ultrasonics | |
| Test number | 1 | 2 | 3 | 4 | 5 | 6 | 7 | 8 | 9 | 10 | 11 | 12 | 13 | 14 | 15 |
| Sediment, % m | | | | | | | | | | | | | | | |
| Top | 9.6 | 9.7 | 0.2 | 0.2 | 9.2 | 10.4 | 9.1 | 9.2 | 8.5 | 8.3 | 7.3 | 0.76 | 0.15 | 0.80 | 0.19 |
| Middle | 9.4 | 9.2 | 2.5 | 0.4 | 9.1 | 10.2 | 9.3 | 9 x | 8.5 | 8.8 | 7.2 | | n.d. | | |
| Bottom | 9.5 | 9.4 | 9.5 | 1.4 | 8.7 | 10.1 | 9.2 | 9.2 | 8.3 | 8.5 | 7.2 | 0.98 | 0.35 | 1.01 | 0.45 |
| Dead bottom | n.d. | n.d. | 26.0 | 29.2 | n.d. | n.d. | 10.3 | 11.1 | 11.0 | 12.1 | | | n.d. | | |
| Sediment, % of initial concentration | | | | | | | | | | | | | | | |
| Top | 96 | 108 | 3 | 2 | 101 | 104 | 99 | 97 | 94 | 97 | 81 | 76 | 15 | 80 | 19 |
| Middle | 94 | 102 | 30 | 5 | 100 | 102 | 101 | 95 | 94 | 102 | 80 | | n.d. | | |
| Bottom | 95 | 105 | 114 | 15 | 95 | 101 | 100 | 97 | 91 | 99 | 80 | 98 | 35 | 101 | 45 |
| Dead bottom | n.d. | | 313 | 321 | n.d. | 112 | 117 | 121 | 141 | | | | n.d. | | |

Example 5

Dispersion Stability of Diesel-microfine Coal Blends

A blend of 1% m microfine coal and marine diesel, plus a fuel oil dispersant additive, was shear mixed at 11,000 rpm in a 100 ml glass sample bottle for 20 minutes, then left to stand at ambient temperature for 1 hour and 24 hours. This was then repeated in an ultrasonic bath. After settling for 1 hr, a 10 mL aliquot of the fuel-coal particle suspension was taken by Eppendorf pipette from the top (first) and from the bottom (second) of the sample. Each aliquot was vacuum filtered through pre-weighed 0.8 μm cellulose nitrate membrane filters using a sintered glass Buchner flask. The solid residue+filter were washed four times with n-heptane before reweighing, after a minimum of 24 hrs drying time, to determine mass of undissolved solids in each aliquot and hence, uniformity of dispersion.

The results, Table 4, show that dispersions of 1% m microfine coal in marine diesel can be produced that are stable for at least 1 hour (test 12). A more uniform dispersion is obtained if shear mixing occurs in an ultrasonic bath (test 14).

In view of the above, it has been surprisingly found that it is possible to engineer coal fines to obtain sufficiently low mineral matter content, moisture content, sulphur content and particle size in order to meet those fuel oil specifications, and which also could be dispersed in fuel oil to provide a dispersion that is stable over at least 48 hours. Furthermore, preparation of a stable, if relatively short term, suspension of fine coal particles with a 1.0% m coal loading in Marine Fuel, which is much less viscous than RFO. The improvement in Flash Point of marine diesel as a result of blending in 1% m microfine coal was also unexpected.

Based on the above results, the present invention shows industrial application in:

Upgrading coal fines so that at blend proportions up to 30% m in fuel oil, the resultant blend of fuel oil and microfine coal appears suitable to use for blends that would meet the limits of the main properties (such as ash, water, density, viscosity and calorific value) in the fuel oil specification.

Reducing fuel oil sulphur content for those grades of fuel oil where fuel oil sulphur content exceeds that of microfine coal.

A way of increasing fuel oil density and viscosity, e.g. addition of approximately 10% m microfine coal can change the fuel oil grade to the next heaviest fuel oil grade.

Reducing use of fuel oil by introducing a lower cost blend component, yet providing equivalent performance.

The improvement in Flash Point of marine diesel and RFO as a result of blending in microfine coal.

Although particular embodiments of the invention have been disclosed herein in detail, this has been done by way of example and for the purposes of illustration only. The aforementioned embodiments are not intended to be limiting with respect to the scope of the invention. It is contemplated by the inventors that various substitutions, alterations, and modifications may be made to the invention without departing from the spirit and scope of the invention.

The invention claimed is:

1. A fuel oil composition comprising:

(i) a particulate material, wherein at least about 90% by volume (% v) of the particles are no greater than about 20 microns in diameter; and (ii) a liquid fuel oil;

wherein the particulate material is present in an amount of at most about 30 by mass (% m) based on the total mass of the fuel oil composition;

wherein the particulate material comprises coal, wherein the coal comprises sedimentary mineral-derived solid carbonaceous material selected from hard coal, anthracite, bituminous coal, sub-bituminous coal, brown coal, lignite, or combinations thereof; and wherein the particulate material comprises less than 5% m of ash content.

2. A fuel oil composition of claim 1, wherein the particulate material comprises microfine coal.

3. A fuel oil composition of claim 2, wherein at least 95% v of the particles are no greater than about 20 microns in diameter.

4. A fuel oil composition of claim 1, wherein the particulate material is dewatered prior to combination with the liquid fuel oil.

5. A fuel oil composition of claim 1, wherein the particulate material is subjected to a de-ashing step or a demineralizing step prior to combination with the liquid fuel oil.

6. A fuel oil composition of claim 2, wherein the microfine coal comprises an ash content of less than about 1% m.

7. A fuel oil composition of claim 1, wherein the liquid fuel oil is selected from one of the group consisting of: marine diesel; diesel for stationary applications; kerosene for stationary applications; marine bunker oil; residual fuel oil; and heavy fuel oil.

8. A fuel oil composition of claim 1, wherein the liquid fuel oil conforms to main specification parameters included in one or more of the fuel oil standards selected from the group consisting of: ISO 8217:2010; ISO 8217:2012; ASTM D396; ASTM D975-14; BS 2869:2010, GOST10585-99, GOST10585-75 and equivalent Chinese standards.

9. A fuel oil composition of claim 1, wherein the fuel oil composition conforms to main specification parameters included in one or more of the fuel oil standards selected from the group consisting of: ISO 8217:2010; ISO 8217:2012; ASTM D396; ASTM D975-14; BS 2869:2010, GOST10585-99, GOST10585-75 and equivalent Chinese standards.

10. A fuel oil composition of claim 1, wherein the particulate material is present in an amount of at least about 0.01% m to at most about 20% m based on the total mass of the fuel oil composition.

11. A fuel oil composition of claim 1, wherein the fuel oil composition comprises the particulate material in the form of a dispersion.

12. A fuel oil composition of claim 11, wherein the dispersion is stable for at least 24 hours.

13. A fuel oil composition of claim 1, wherein the fuel oil composition comprises a dispersant additive.

14. A fuel oil composition comprising:

(i) a particulate material, wherein at least about 90% by volume (% v) of the particles are no greater than about 20 microns in diameter; and (ii) a liquid fuel oil selected from one of the group consisting of: marine diesel; diesel for stationary applications; kerosene for stationary applications; marine bunker oil; residual fuel oil; and heavy fuel oil; and wherein the particulate material comprises coal; and wherein the particulate material comprises less than 5% m of ash content.

15. A fuel oil composition of claim 14, wherein the particulate material is present in an amount of at least about 0.01% m to at most about 20% m based on the total mass of the fuel oil composition.

16. A fuel oil composition of claim 14, wherein the particulate material comprises microfine coal.

17. A fuel oil composition of claim 16, wherein the microfine coal comprises an ash content of less than about 1% m.

18. A fuel oil composition of claim 14, wherein at least 95% v of the particles are no greater than about 20 microns in diameter.

19. A fuel oil composition of claim 14, wherein the particulate material is dewatered prior to combination with the liquid fuel oil.

20. A fuel oil composition of claim 14, wherein the liquid fuel oil conforms to main specification parameters included in one or more of the fuel oil standards selected from the group consisting of: ISO 8217:2010; ISO 8217:2012; ASTM D396; ASTM D975-14; BS 2869:2010, GOST10585-99, GOST10585-75 and equivalent Chinese standards.

* * * * *